United States Patent [19]

Carella

[11] 4,078,537

[45] Mar. 14, 1978

[54] WEIGHT REDUCTION BOW

[76] Inventor: Richard F. Carella, 35572 Strathcona, Mount Clemens, Mich. 48043

[21] Appl. No.: 673,914

[22] Filed: Apr. 5, 1976

[51] Int. Cl.[2] ..... F41B 5/00

[52] U.S. Cl. ..... 124/24 R; 124/89

[58] Field of Search ..... 124/23 R, 24 A, 24 R, 124/23 A, 35 A, 22

[56] References Cited

U.S. PATENT DOCUMENTS

| | | | |
|---|---|---|---|
| 3,486,495 | 12/1969 | Allen | 124/24 R |
| 3,552,373 | 1/1971 | Van Hecke | 124/24 R |
| 3,595,213 | 7/1971 | Storer | 124/22 UX |
| 3,625,193 | 12/1971 | Palma | 124/23 R |
| 3,744,473 | 7/1973 | Nishioka | 124/24 R |
| 3,874,359 | 4/1975 | Cesin | 124/35 A |
| 3,989,026 | 11/1976 | Nishioka | 124/24 R |

*Primary Examiner*—George J. Marlo
*Attorney, Agent, or Firm*—McGlynn and Milton

[57] ABSTRACT

An archery bow assembly including a pair of limbs each of which has a distal end. Each distal end includes a first surface connected at a ridge to a second surface. A third surface extends from each of the second surfaces and the second and third surfaces define a ledge. In a first embodiment, a bowstring is connected to a pair of rigid links and each of the links is pivotally connected to a respective support arm extending rigidly from the adjacent limb for pivotal movement of each of the links relative to the support arms. Each link rotatably supports a roller at its distal end for movement over the adjacent first surface, over the ridge, onto the second surface and onto the third surface as the bowstring is drawn from a rest position through a predetermined drawn position. The drawing force follows a continuous curve to the predetermined drawn position where the curve becomes discontinuous as the rollers move over the adjacent ridges and onto the second surfaces thereby transferring a predetermined amount of the drawing force from the bowstring through the links to the support arms. In second and third embodiments the links are replaced by flexible cable arms.

26 Claims, 14 Drawing Figures

WEIGHT REDUCTION BOW

This invention relates to archery bow assemblies.

When using archery bow assemblies for hunting or other sporting purposes it is often necessary to propel an arrow with great force to attain the desired flight. In the common situation, the bowstring connected to the ends of the bow limbs must be pulled back with greater and greater force during the draw in order to obtain the desired force in a fully drawn position to propel the arrow with the desired force. The hunter or sports enthusiast must continue to exert a high level of force in the fully drawn position in order to be ready to quickly fire the fully drawn bow. It is, therefore, advantageous to provide a bow which may be held in its fully drawn position with the requisite forces in the limbs for propelling the arrow but with a reduced draw force, i.e., a draw force which increases and then is reduced in a fully drawn position.

U.S. Pat. No. 3,486,495, granted Dec. 30, 1969 in the name of Holless W. Allen, discloses rotatable variable leverage pulley members mounted on the distal ends of the limbs and a bowstring is disposed over the pulley members to provide a mechanical advantage. Because of this arrangement, less force is required to hold the bowstring in a fully drawn position than is required to hold the bowstring at an intermediate drawn position. The draw force in such an assembly follows a continuous curve as the draw distance increases and subsequently decreases. In other words, the drawing force increases to a maximum value and then slowly decreases as the draw distance increases from the maximum value of the drawing force.

U.S. Pat. No. 3,794,012, granted Feb. 26, 1974 in then name of James C. Ramsey, discloses another solution to this problem by providing an archery bow assembly including braces which relieves tension in the archer's arm in the drawn position.

An archery bow assembly constructed in accordance with this invention comprises a pair of limbs having distal ends and draw force control means on the distal ends to coact with a bowstring for controlling the drawing force thereof so that the drawing force follows a continuous curve to a predetermined drawn position where the curve becomes discontinuous whereby the drawing force is abruptly reduced to a predetermined amount.

Other advantages of the present invention will be readily appreciated as the same becomes better understood by reference to the following detailed description when considered in connection with the accompanying drawings wherein.

Figure 6:
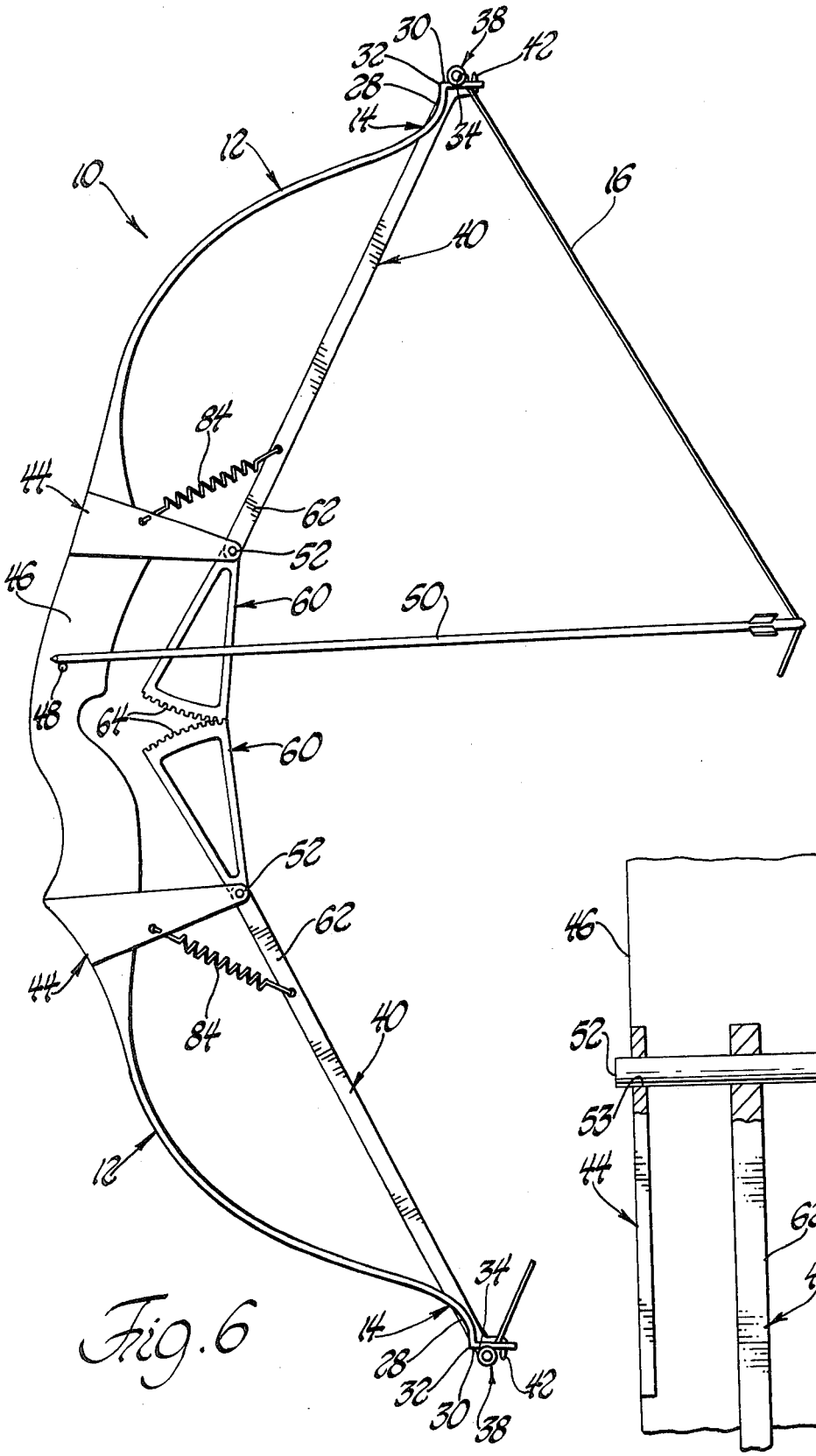
FIG. 6 is a view similar to FIG. 1 but showing the assembly in the fully drawn position.
Figure 7:
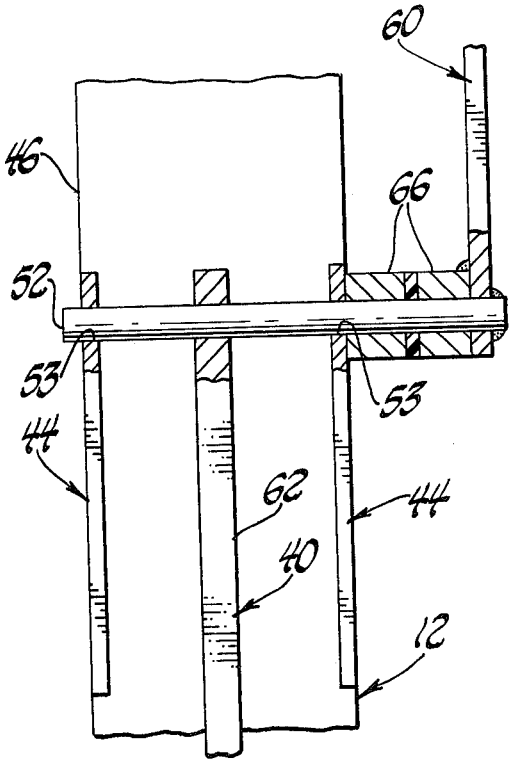
FIG. 7 is a view substantially along line 7—7 of FIG. 1 and partially broken away and in cross section.
Figure 8:
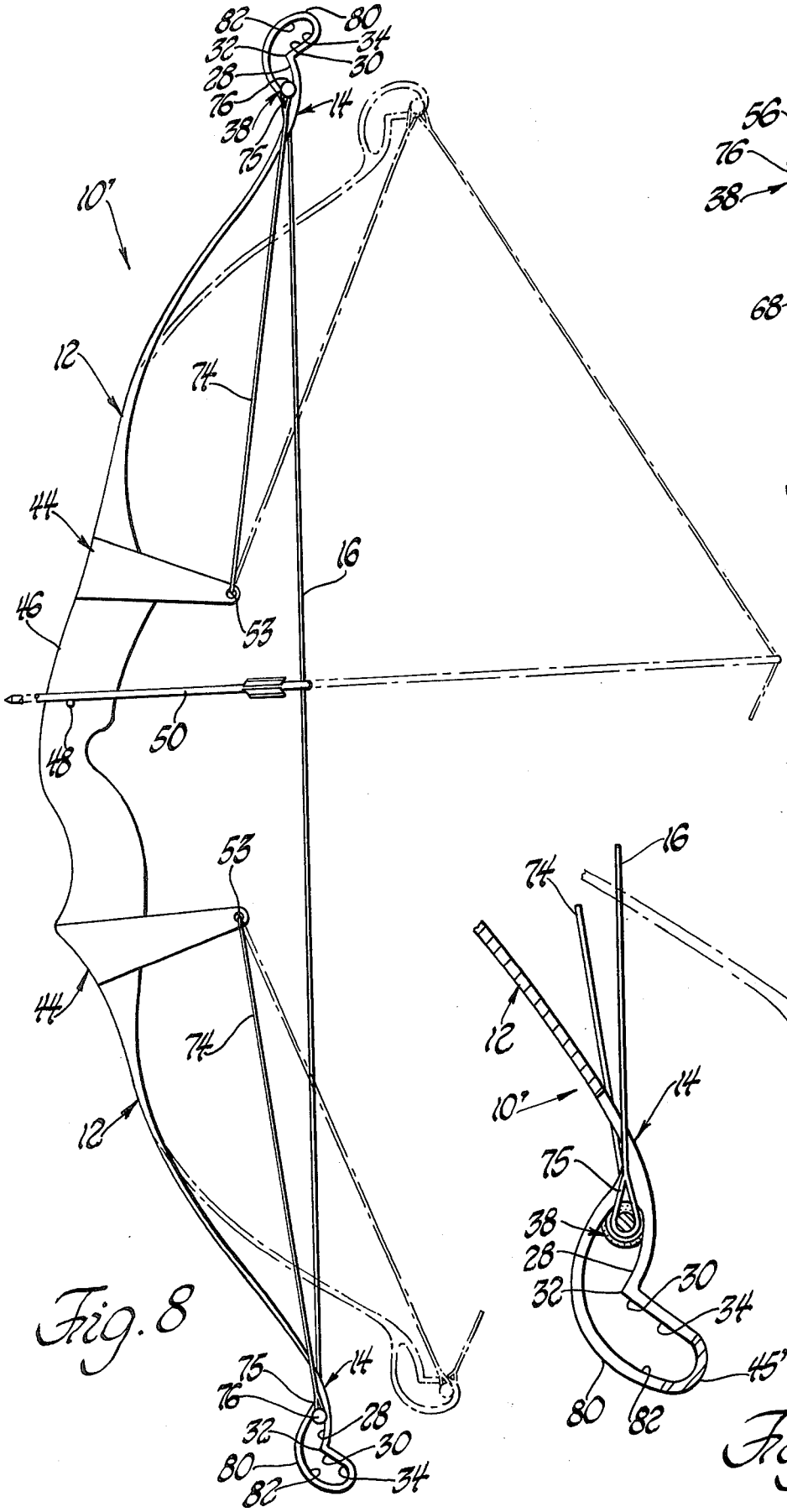
FIG. 8 is a side-elevational view of a second embodiment of the subject invention showing the archery bow assembly in a rest position in full lines and in a fully drawn position in phantom lines.
Figure 11:
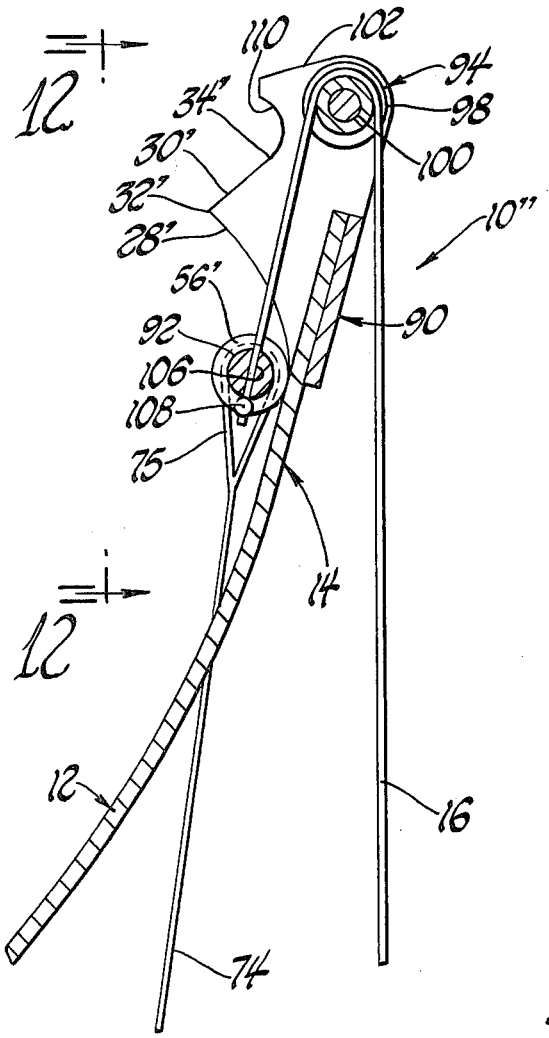
FIG. 11 is an enlarged, fragmentary, cross-sectional view similar to FIG. 4 but showing a third embodiment of the subject invention.
Figure 12:
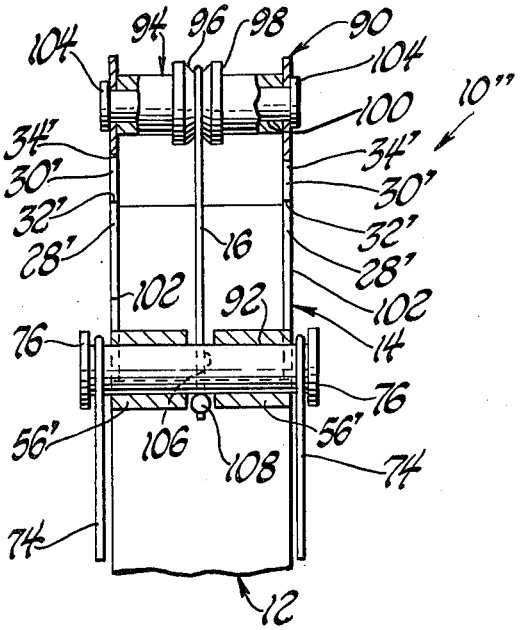
FIG. 12 is a front-elevational view taken substantially along line 12—12 of FIG. 11.
Figure 13:
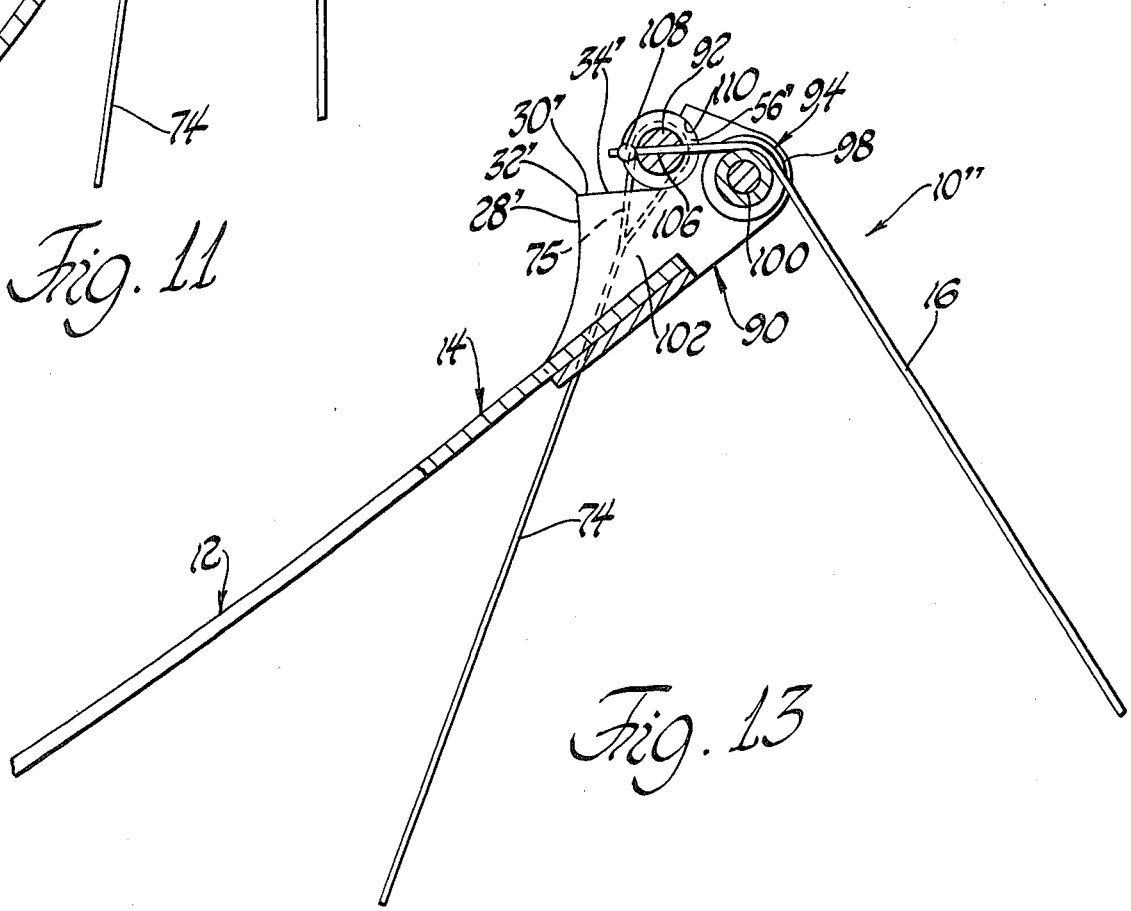
FIG. 13 is a view showing the embodiment in FIG. 11 in the fully drawn position.

Referring now to the drawings, a first embodiment of the subject invention is generally shown at 10 in FIGS. 1 through 7, a second embodiment is generally shown at 10' in FIG. 8 and a third embodiment is generally shown at 10" in FIGS. 11 through 13.

Figure 1:
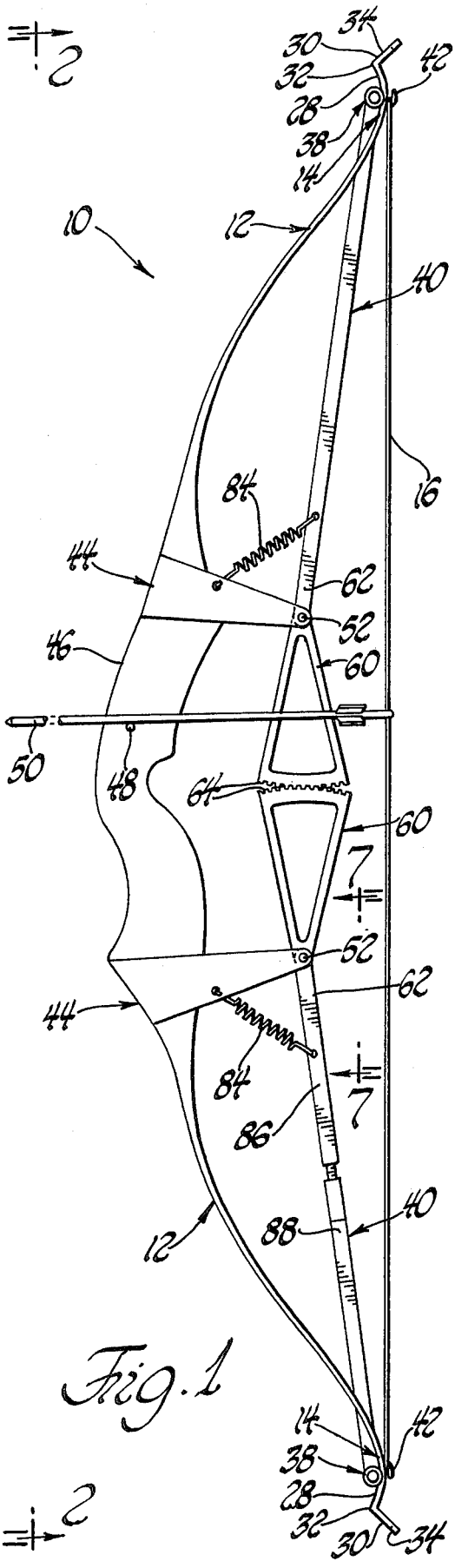
FIG. 1 is a side-elevational view showing a preferred embodiment of the subject invention.

The first embodiment of the archery bow assembly generally shown at 10 comprises a pair of limbs each of which is generally indicated at 12. Each of the limbs 12 has a distal end generally indicated at 14 on which is supported a draw force control means to coact with a bowstring 16 for controlling the drawing force of the bowstring 16 so that the drawing force follows a continuous curve to a predetermined drawn position where the curve becomes discontinous for abruptly reducing the drawing force a predefermined amount. The drawing force of the bowstring 16 is defined as the force necessary to hold the bowstring 16 in a drawn position, one of many such drawn positions being shown in FIG. 6 whereas FIG. 1 shows the bowstring 16 in a rest or strung position.

Figure 14:
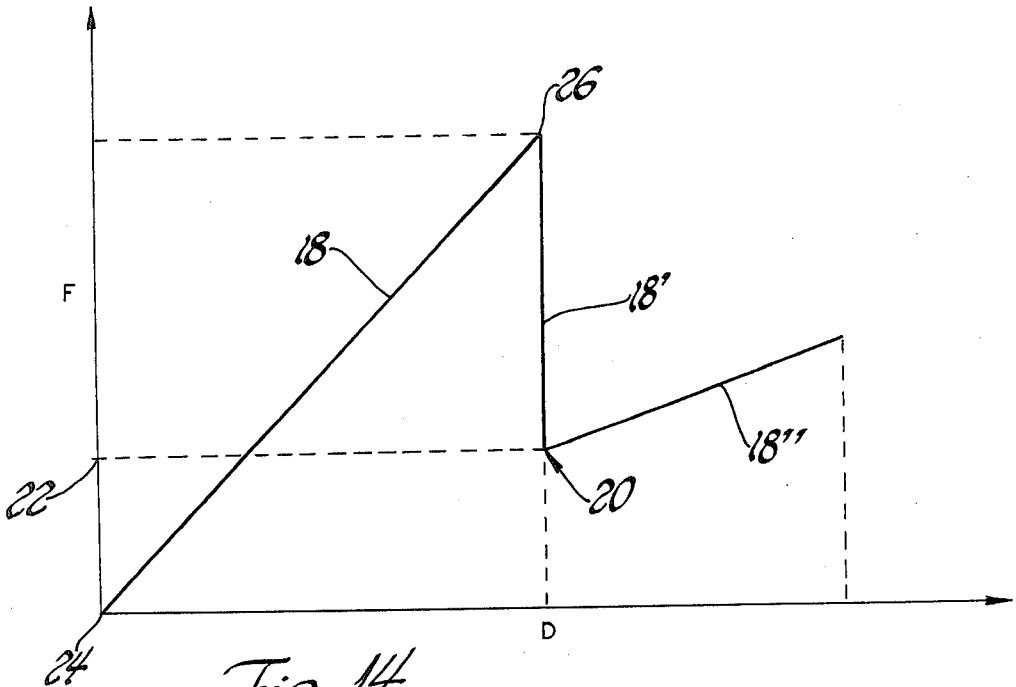
FIG. 14 is a graph illustrating the drawing force characteristics of a bow assembly utilizing the subject assembly.

FIG. 14 shows a graph plotting the bowstring drawing force F along the abscissa against the bowstring draw distance D along the ordinate.

The draw force control means controls the drawing force so that the drawing force follows a curve 18 which is continuous as seen in FIG. 14 to a predetermined or intermediate drawn position 26 where the curve 18 becomes discontinuous or ends whereby the draw force is abruptly reduced along a second curve 18' to a predetermined amount at 20, which is indicated at 22 on the ordinate. In other words, as illustrated on the graph in FIG. 14, the bowstring is drawn from a rest position 24 to an intermediate drawn position 26 upon application of a continually increasing bowstring drawing force which follows the curve 18. The bowstring 16 moves through the intermediate position 26 and immediately reaches the adjacent drawn position 20, the intermediate position 26 being between the rest position 24 and the drawn position 20. The drawing force required to hold the bowstring 16 in the intermediate position 26 is substantially greater than the draw force 22 required to hold the bowstring 16 in the drawn position 20.

In other words, the curve 18 is continuous, as it is smooth from one point to the next along the curve as it progresses in both directions along the abscissa and along the ordinate until it becomes discontinuous. The curve becomes discontinuous when it abruptly ends, or abruptly changes positions along the abscissa, as a result of a very slight movement to an adjacent point along the ordinate. In other words, the curve 18 is discontinuous at the predetermined point of draw 26 as it may end there or drop abruptly along the abscissa to point 20 upon a very small or slight increment of increased draw D to the next adjacent point along the ordinate. Within this definition and in a more limited sense, the curve may be precisely defined as discontinuous in the well-known mathematical terms of integral calculus. As illustrated, each of the first surfaces 28 is defined by the inner face of the bow limbs. Although this will be appreciated as the description proceeds, the entire control means, including the surfaces 28, may be defined by components separate from the bow limbs and simply attached to the bow limbs.

The control means includes a first surface 28 at each of the distal ends 14. The control means also includes a fixing means including the second surfaces 30 each of which extends from one of the respective first surfaces 28 at right angles or approximately 90° relative thereto and each of the first and second surface pairs are interconnected by or intersect at a ridge 32. The second surfaces 30 defining the fixing means are disposed for fixing the predetermined amount 22 to which the draw force is reduced as will become more apparent hereinafter.

The assembly 10 also includes pilot means including a third surface 34 extending from each of said second surfaces 30 for determining the curve 18'' followed by the drawing force from the predetermined amount 22 as the bowstring 16 is further drawn from the drawn position 20. The configuration or slope and/or the disposition of the third surfaces 34 determine the configuration of the curve 18''. Each pair of the second and third surfaces are extensions of or continuous with another to define respective ledges on the distal ends 14.

The control means further includes a pair of shifting means, comprising pin and roller assemblies, generally indicated at 38 for moving over or rolling on the first surfaces 28, over the ridges 32, onto the second surfaces 30, and over the third surfaces 34. The control means includes spacer means connected to the pin and roller assemblies 38 for spacing apart the two pin and roller assemblies 38 and for limiting the movement of the pin and roller assemblies 38 to predetermined paths which are arcuate in response to the drawing force and resulting draw D of the bowstring 16. The spacer means also applies a portion of the force applied to the limbs 12. When the pin and roller assemblies 38 are on their second surfaces 30, the spacer means through the pin and roller assemblies 38 applies a limb-flexing force corresponding to the amount of drawing force which was reduced along the second curve 18' to the limbs 12.

In the first embodiment, the spacer means comprise a pair of rigid links each generally indicated at 40. The links 40 each have a finger 42 extending therefrom to which a looped portion of the bowstring 16 is connected for effecting a force transmitting connection between the bowstring 16 and the links 40. Two support arms, ech generally indicated at 44, extend rigidly from the limbs 12 and the links 40 are pivotally connected to and supported by the respective support arms 44. Thus, the outward ends of the links 40 supporting the pin and roller assemblies 38 move in arcuate or circular paths about their respective pivotal connections to the support arms 44.

During the drawing of the bow assembly the limbs 12 are flexed rearwardly whereby the distal ends thereof move in curved paths (which may not be circular) and each pin and roller assembly 38 rolls over its respective first surface 28 as each link 40 pivots rearwardly in an arcuate path about its respective support arm 44 and during this initial movement, the drawing force follows the curve 18 which is continuous from the rest position 24. Once the intermediate position 26 is reached, the pin and roller assemblies 38 roll over their respective ridge 32 to cause the drawing force to be abruptly reduced to the predetermined amount 22 as the drawing force abruptly falls along the curve 18'. The slope of the second surface 30 onto which the pin and roller assembly 38 moves fixes the predetermined amount 22. In other words, the slope or configuration of the second surface 30 for any given assembly 10 will determine the corresponding predetermined amount 22 of drawing force which is needed to maintain each of the pin and roller assemblies 38 on their respective second surfaces 30 and prevent them from moving back over their respective ridges 32 as a result of the limb forces in the link 40. It is important to note that once the pin and roller assemblies 38 are on their respective second surfaces 30 and the links 40 and limbs 12 are in the position shown in FIG. 6, force triangles are formed by the limbs 12, the support arms 44 and the links 40, which force triangles receive a portion of the drawing force thereby to abruptly reduce the drawing force as soon as the force triangles are formed. In other words, the forces directed along the limbs 12, the support arms 44 and the links 40 define three-sided force triangles which abruptly reduce the drawing force once the pin and roller assemblies 38 are on their respective second surfaces 30. Said another way, the rollers of the pin and roller assembies 38 are in frictional engagement with the second surfaces 30 to transmit forces through the links 40 to help the limbs 12 in the drawn flexed position, thus relieving the draw force necessary to hold the bowstring. Consequently, the draw fiorce required to be manually applied to the bowstring to maintain the drawn position 20 is represented by the predetermined amount 22 which in turn is a function of the geometry of the components such as the disposition of the surfaces 30.

Once on the second surfaces 30, the pin and roller assemblies 38 may then move over the respective third-surfaces 34 as the draw is increased to establish the curve 18''. The curve 18'' is followed by the drawing force from the predetermined amount 22 as the bowstring 16 is further drawn from the drawn position 20. The slope of the curve 18'', as the bowstring 16 is further drawn from the drawn position 20, is determined by the slope or disposition of the third surface 34 taken in combination with the geometry of the remaining components. The force triangles are still formed until a check means comprising a cross member 44 of the pilot means stops movement of the links 40 relative to limbs 12 and consequently the movement of the pin and roller assemblies 38.

The limbs 12 extend from and are interconnected by a handle section 46 of the bow. The handle section 46 includes an arrow shelf 48 for supporting an arrow 50.

Figure 3:
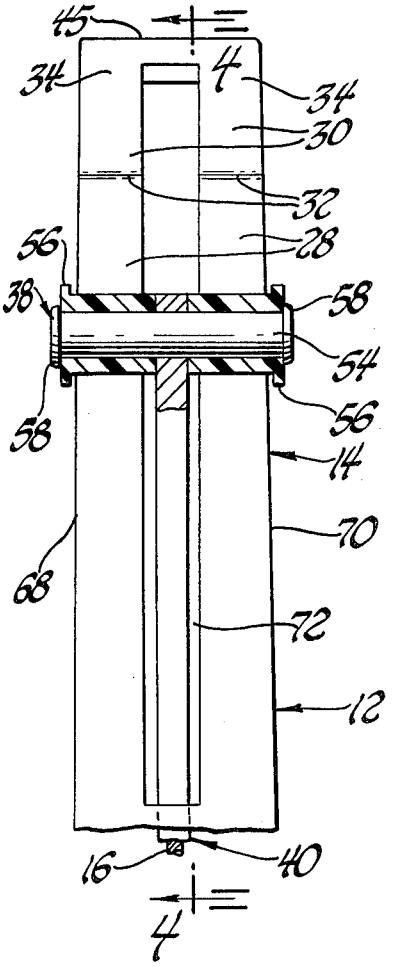
FIG. 3 is an enlarged fragmentary view similar to FIG. 2 but showing only the one distal end of the bow assembly.
Figure 4:
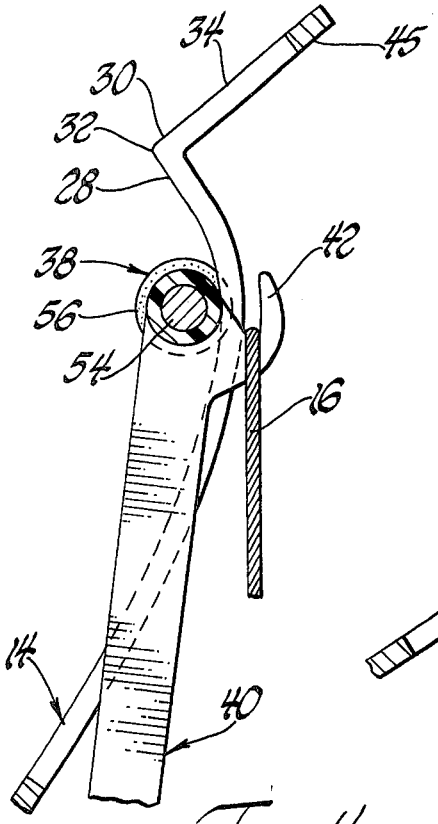
FIG. 4 is a cross-sectional view taken substantially along line 4—4 of FIG. 3.
Figure 5:
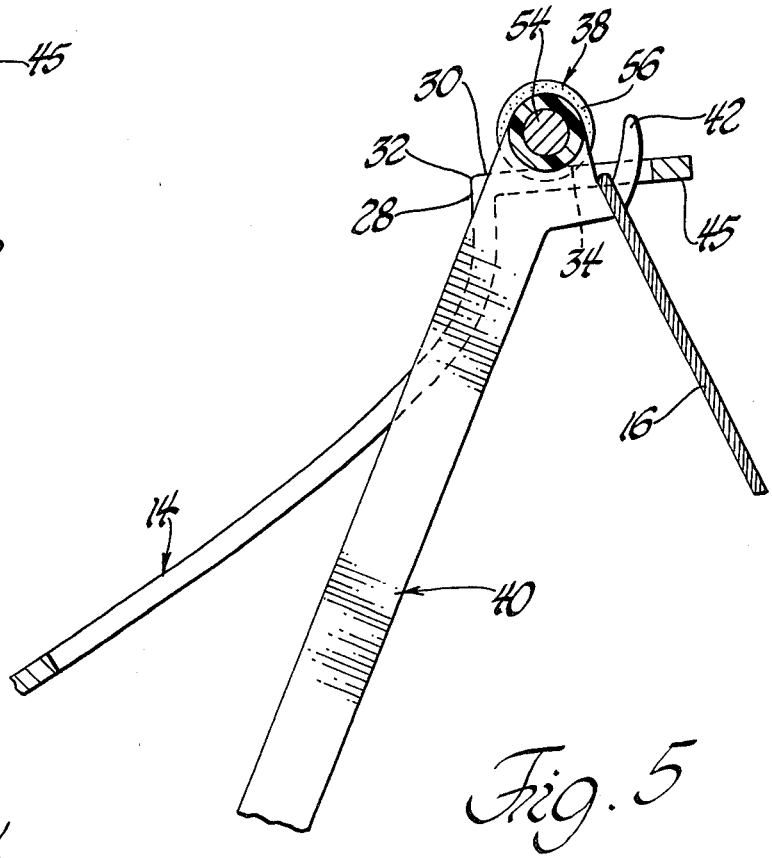
FIG. 5 is a view similar to FIG. 1 but showing the components in a drawn position.

As shown in FIG. 7, each link 40 is pivotally connected to its respective support arm 44 at one of its ends 62 by a pivot pin 52 which extends through apertures 53 in the support arms 44. The opposite or outward end of each of the links 40 is connected to its respective pin and roller assembly 38. As best shown in FIG. 3, each pin and roller assembly 38 comprises a pin 54 and two rollers 56 spaced apart and rotatably mounted on the pin 54. The links 40 are connected to the respective pins 54 between the rollers 56. The rollers 56 are secured on the pins 54 and against the link 40 by locking or snap rings 58 mounted in grooves in opposite ends of the pins 54.

The first embodiment also includes interlocking means or a pair of gear portions or sectors generally indicated at 60. Each gear sector 60 extends from and is non-rotatably connected to one of the links 40. The gear sectors 60 interlock or mesh the ends 62 of the links 40 as the ends 62 pivot through a plurality of interlocking positions. The ends 62 of the links 40 are forced to move through interlocking positions by means of the gear sectors 60 which have teeth 64 which mesh together upon the pivotal movement of the links 40. In other words, the gear sectors 60 synchronize the movement of the links 40 so that the links pivot in unison. The limbs 12 urge the pin and roller assemblies 38 to the left as shown in FIG. 6 and thereby urge the links 40 to pivot forwardly. The links 40 and the gear portions 60 are fixedly attached to their respective pivot pins 52, as shown in FIG. 7. Therefore, when the links 40 pivot with respect to support arms 44, the gear portions 60 also pivot with respect to support arms 44 and hence mesh together at the teeth 64. In other words, the pivot pins 52 transfer the pivotal movement of the ends 62 of the links 40 to their respective gear portions 60 to synchronize the movement of the distal ends 14. Thus, the gear sectors 60 mesh together at the teeth 64 as the limbs 12 move from a limb-flexing position, wherein the limbs are flexed as shown in FIG. 6, toward a rest position as seen in FIG. 1 to propel the arrow 50. The gear sectors 60 and the links 40 define synchronizing means interconnecting the distal ends 14 of the limbs 12 to coact with the bowstring 16 for equalizing or synchronizing the movement of the distal ends 14.

A pair of spools or bushings 66 space each of the gear sectors 60 from the adjacent support arms 44 so that the gear sectors 60 do not interfere with the arrow 50 as it moves along the arrow shelf 48. The gear sectors 60 may be fixedly secured to their respective pivot pins 52 in any number of ways well-known in the art.

Figure 2:
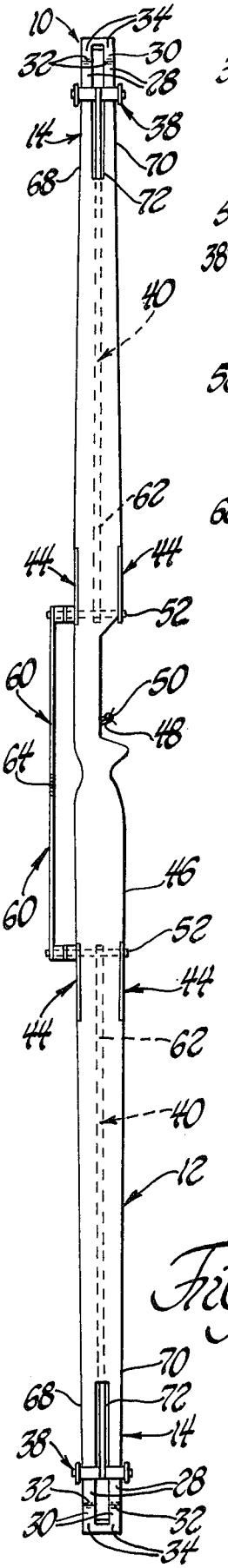
FIG. 2 is a front-elevational view taken substantially along line 2—2 of FIG. 1.

As illustrated in FIGS. 2 and 3, the distal ends 14 and the second and third surfaces 30 and 34 are bifurcated thereby forming two branches 68 and 70 with a slot 72 between the two branches 68 and 70. The links 40 extend through the slots 72 and are connected to the roller pins 54 as previously described.

The pilot means further includes a pair of biasing means or a pair of biasing springs 84 which interconnect the respective support arms 44 and the links 40 for urging the links 40 to pivot towards the support arms 44 or the limbs 12. The biasing springs 84 in combination with the third surfaces 34 determine the curve 18" followed by the drawing force from the predetermined amount 22 as the bowstring 16 is further drawn from the drawn position 20. The biasing springs 84 require a greater drawing force to further draw back the bowstring 16 a predetermined distance from the predetermined drawn position 20.

As shown in FIG. 1, one of the links 40 is adjustable in length and preferably both links 40 include this length varying feature. The adjustable link 40 includes a first section 86 and a second section 88. The second section 88 is adjustably screwed onto the first section 86 or a second section 88 of a different length may be screwed onto the first section 86 such that the total length of the link 40 is variable. The effect of such a variability feature is that the drawn position 20 may be varied or adjusted to the left or to the right as shown on FIG. 14 depending on whether the total length of the links 40 is increased or decreased. In other words, by making the total length of the links 40 greater, the pin and roller assemblies 38 travel a shorter distance on the first surfaces 28 before moving over the respective ridges 32, thereby requiring less drawing force to reach the predetermined drawn position 26 where the drawing force is abruptly reduced.

Figure 9:
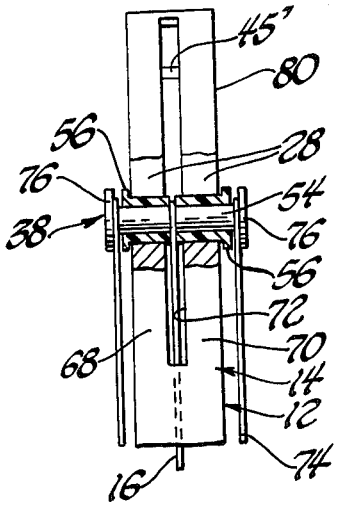
FIG. 9 is an enlarged fragmentary front-elevational view partially broken away and in cross section of one distal end of the embodiment of FIG. 8.
Figure 10:
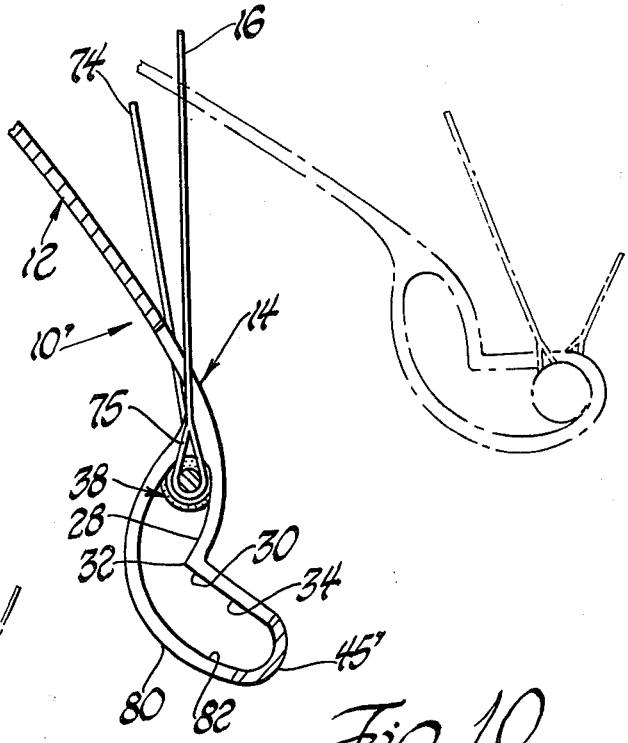
FIG. 10 is an enlarged, fragmentary, cross-sectional side view of one distal end of the embodiment of FIG. 8 showing the rest and fully drawn positions in full and phantom lines respectively.

The second embodiment of FIGS. 8 through 10 includes the same or equivalent components and features indicated with the same numerals as the like components and features of the first embodiment but differs in these respects now described. In the second embodiment, the spacer means comprises upper and lower flexible cable arms 74 each of which comprises two strands. Each cable strand 74 has a looped part 75 for attachment to the respective roller pins 54. The looped parts 75 of the cable strands 74 are secured about opposite ends of the roller pins 54 and are retained in position by end caps 76. Each cable arm 74 includes a strand extending inwardly from a looped part 75 looped about one end of roller pin 54, through apertures 53 formed in the ends of the support arms 44, and a strand extending outward to be attached at the other end of the roller pin 54 by another looped part 75. Thus, each of the cable arms 74 are connected to their respective roller pins 54 exteriorly of their respective slots 72. The bowstring 16 extends through the slot 72 and is connected to the pin 54 between the rollers 56 as shown in FIG. 9.

As shown in FIGS. 8 and 10, a pair of retainer portions 80 are attached to or are integral with the respective distal ends 14. Each combination of a retainer portion 80, a first surface 28, a ridge 32 and second and third surfaces 30 and 34 define a retainer space 82 in which the pin and roller assemblies 38 are confined to move. The retainer spaces 82 are needed to prevent the pin and roller assemblies 38 from moving off and away from the distal ends 14 due to the fact that the pin and roller assemblies 38 are free to move as the flexible cable arms 74 do not limit or control movement thereof as the rigid links 40 of the first embodiment.

The third embodiment of the subject invention is illustrated in FIGS. 11 through 13. A pair of mounting brackets, generally indicated at 90, are mounted on the respective distal ends 14 in an appropriate fashion as by an adhesive, or the like. Like the previous embodiments but indicated with prime (') numerals, each mounting bracket 90 includes a first surface 28', a second surface 30', a third surface 34' and a ridge 32'. The shifting means shown in FIGS. 11 through 13 includes sliding pins 92 on which two rollers 56' are rotatably mounted. The bowstring 16 extends through and is connected to pins 92 and is strung or looped over a force-transmittal means comprising the pulley assemblies generally indicated at 94. The bowstring 16 extends through or is entrained about notches 96 formed in notched pulley members 98 concentrically and fixedly mounted for rotation about pins 100. The pins 100 are rotatably connected to the sides 102 of the mounting brackets 90 and are retained to the sides 102 by pin end caps 104.

The bowstring 16 moves about the notched pulley members 98 to pull the sliding pins 92 and the mounted rollers 56' over the adjacent first, second, and third surfaces, 28', 30' and 34' and ridges 32' in the same fashion as described hereinabove in regard to the first and second embodiments. In other words, the bowstring 16 urges the sliding pins upward or toward the ends of the limbs 12 as shown in FIG. 11 thereby causing the rollers 56' to roll over the surfaces 28', 30', and 34' and ridges 32'. The bowstring 16 extends through an aperture 106 formed in the sliding pin 92 and is secured thereto by a ball 108 fixedly secured to the end of the bowstring 16, the ball 108 having a greater diameter than the aperture 106.

In the third embodiment, the check means includes arcuate fourth surfaces 110 which stop the rolling movement of the rollers 56' on the third surfaces 34'. The fourth surfaces 110 extend from their respective third surfaces 34' to engage the rollers 56' at a drawn position of the bowstring 16.

The operation of the archery bow assembly 10 will now be described as the bowstring 16 is drawn from the rest position 24 as shown in FIG. 1 to a fully drawn position.

Initially, the pin and roller assemblies 34 rest on the first surfaces 28, being urged thereon by the bowstring 16 through fingers 42 of the links 40 and by the links 40 which extend from the support arms 44 towards the distal ends 14. Drawing the bowstring 16 a short distance causes the links 40 to pivot about the support arms 44 in a rearward direction, the pin and roller assemblies 38 flexing the limbs 12 as the pin and roller assemblies 38 roll on the first surfaces 28.

Further drawing the bowstring 16 causes additional pivotal movement of the links 40 and additional flexing of the limbs 12 until the pin and roller assemblies 38 encounter the ridges 32 at which time the pin and roller assemblies abruptly snap or jump onto the second surfaces 30 without any further draw of the bowstring 16. At this time the force triangles are set up thereby abruptly relieving the drawing force that the archer must exert.

Additional drawing of the bowstring 16 causes additional pivotal movement of the links 40 and movement of the pin and roller assemblies 38 over the third surfaces 34 until the pin and roller assemblies 38 engage the check means as the limbs 12 are further flexed. Even after such engagement the limbs 12 may be even further flexed until a fully drawn position is reached by further rawing of the bowstring 16 to cause the resultant pivotal movement of the links 40. All the while the pin and roller assemblies 38 are on the ledges defined by the second and third surface pairs, the force triangles are formed to thereby reduce the amount of drawing force needed to hold the bowstring 16.

The invention has been described in an illustrative manner, and it is to be understood that the terminology which has been used is intended to be in the nature of the words of description rather than of limitation.

Obviously, many modifications and variations of the present invention are possible in light of the above teachings. It is, therefore, to be understood that the invention may be practiced otherwise than as specifically described herein and yet remain within the scope of the appended claims.

The embodiment of the invention in which an exclusive property or privilege is claimed are defined as follows:

1. An archery bow assembly comprising; a pair of limbs having distal ends, first and second intersecting surfaces on each of said distal ends, a ridge disposed at the intersection of said surfaces, draw force control means for moving over said surfaces and said ridge for reducing the bowstring draw force upon moving over said ridges in response to movement of said limbs by the bowstring.

2. An assembly as set forth in claim 1 wherein said draw force control means includes shifting means for engaging said suface and spacer means operatively interconnecting said shifting means and bow assembly at a position spaced from said distal ends for limiting movement of said shifting means to predetermined paths.

3. An assembly as set forth in claim 2 including spacer means operatively interconnecting said shifting means and said bow assembly at a position spaced from said distal ends for limiting movement of said shifting means to predetermined arcuate paths which intersect the paths of movement of said ridges during movement of said limbs by the bowstring.

4. An archery bow assembly comprising; a handle section, a pair of limbs extending from said handle section and including distal ends which are movable in response to the drawing force of a bowstring operatively connected thereto between an at-rest position and a fully-drawn position, and draw force control means operatively interconnecting at least one of said distal ends and said bow assembly at a position spaced from said one distal end for applying a force to said one distal end at a predetermined drawn position so that the drawing force follows a continuous curve to said predetermined drawn position at which the drawing force is reduced a predetermined amount, said control means including a first surface on said one distal end and fixing means for fixing said predetermined amount to which the drawing force is reduced and comprising a second surface on said one distal end, said first surface being connected to said second surface at a ridge.

5. An assembly as defined in claim 4 including pilot means for determining the subsequent curve followed by the drawing force from said predetermined amount as the bowstring is further drawn from said predetermined drawn position.

6. As assembly as defined in claim 5 wherein said control means includes shifting means for moving over said first surface, over said ridge at said predetermined drawn position, and over said second surface.

7. An assembly as defined in claim 6 wherein said pilot means includes a third surface extending from said second surface, said third surface being configured and disposed to determine the configuration of said subsequent curve from said predetermined amount.

8. An assembly as defined in claim 7 wherein said control means includes spacer means connected to said shifting means for limiting movement of said shifting means to a predetermined path.

9. An assembly as defined in claim 8 wherein said spacer means includes at least one flexible cable.

10. An assembly as defined in claim 9 wherein said distal ends are alike and further comprising a pair of retainer portions attached to respective distal ends, said retainer portions defining a closed retainer space with said first, second and third surfaces, said shifting means being confined to move within said retainer spaces.

11. An assembly as defined in claim 6 wherein said pilot means includes check means for stopping movement of said shifting means relative to said limbs subsequent to movement over said ridges.

12. An assembly as defined in claim 8 wherein said distal ends are alike and each of said distal ends is bifurcated thereby forming two branches with a slot therebetween for allowing an interconnection between said bowstring and said shifting means.

13. An assembly as defined in claim 8 wherein said distal ends are alike and including at least one support arm extending from said limbs and said spacer means being connected to said support arm to limit movement of said shifting means to said predetermined paths which are arcuate about the connection between said support arm and said spacer means.

14. An assembly as defined in claim 8 wherein said spacer means comprises a pair of rigid links adapted for connection with the bowstring thereto.

15. An assembly as set forth in claim 14 wherein each of said links are supported for pivotal movement relative to said limbs to limit movement of said shifting means to said predetermined paths which are arcuate.

16. An assembly as defined in claim 15 wherein each of said links includes a gear portion associated therewith and wherein said gear portions mesh together upon pivotal movement of said links in response to pivotal movement thereof to cause said links to pivot in unison.

17. An assembly as defined in claim 8 wherein said distal ends are alike an each of said shifting means includes a pin and a roller rotatably mounted on said pin for movement over said first surface and over said ridge and onto said second surface.

18. An assembly as defined in claim 8 wherein said pilot means further includes at least one biasing means associated with said limbs and said spacer means for urging said spacer means toward said limbs in response to the drawing force.

19. An assembly as defined in claim 8 wherein each of said limbs having a support arm extending rigidly therefrom, said pilot means further includes a pair of biasing means interconnecting said respective support arms and said spacer means for urging said spacer means towards said support arms.

20. An assembly as defined in claim 19 wherein each of said biasing means comprises a biasing spring.

21. An assembly as defined in claim 8 wherein said control means includes force-transmittal means over which the bowstring may be looped adjacent each end of said limbs and attached to said shifting means for moving said shifting means toward said distal ends.

22. An assembly as defined in claim 21 wherein said force-transmittal means comprises a pulley assembly.

23. An assembly as defined in claim 8 wherein said pilot means includes check means for stopping said movement on said third surface.

24. An assembly as defined in claim 4 including a bowstring coacting with said distal ends.

25. An assembly as defined in claim 4 wherein said control means includes spacer means for varying said predetermined drawn position.

26. An assembly as defined in claim 4 wherein said control means includes force transmittal means over which the bowstring may be looped adjacent each of said distal ends of said limbs.

* * * * *